US010894278B2

(12) United States Patent
Fujiwara

(10) Patent No.: US 10,894,278 B2
(45) Date of Patent: Jan. 19, 2021

(54) METHOD FOR PRODUCING SEAMLESS METAL TUBE

(71) Applicant: NIPPON STEEL & SUMITOMO METAL CORPORATION, Tokyo (JP)

(72) Inventor: Masakazu Fujiwara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 198 days.

(21) Appl. No.: 15/883,181

(22) Filed: Jan. 30, 2018

(65) Prior Publication Data

US 2018/0154410 A1 Jun. 7, 2018

Related U.S. Application Data

(62) Division of application No. 14/394,578, filed as application No. PCT/JP2013/058352 on Mar. 22, 2013, now abandoned.

(30) Foreign Application Priority Data

Apr. 18, 2012 (JP) ..... 2012-094793

(51) Int. Cl.
*B21B 19/04* (2006.01)
*B21B 19/06* (2006.01)
(Continued)

(52) U.S. Cl.
CPC ..... *B21B 19/04* (2013.01); *B21B 3/02* (2013.01); *B21B 19/06* (2013.01); *B21B 25/00* (2013.01);
(Continued)

(58) Field of Classification Search
CPC ..... B21B 3/02; B21B 13/12; B21B 25/00; B21B 45/004; B21B 17/02; B21B 17/04;
(Continued)

(56) References Cited

U.S. PATENT DOCUMENTS 3,818,733 A 6/1974 Cauley
4,578,974 A 4/1986 Pozsgay
(Continued)

FOREIGN PATENT DOCUMENTS

CN 101045978 10/2007
CN 101811149 8/2010
(Continued)

OTHER PUBLICATIONS

Machine Translation of JPh01-181905 retrieved from EPO website (espacenet.com) retrieved Dec. 12, 2019. (Year: 1989).*
(Continued)

*Primary Examiner* — Peter Dungba Vo
*Assistant Examiner* — Joshua D Anderson
(74) *Attorney, Agent, or Firm* — Clark & Brody LP

(57) ABSTRACT

Provided is a round billet capable of reducing damage on a piercing plug in a method of producing a seamless metal tube with a Mannesmann process. The round billet (5), for use in a seamless metal tube, to be produced into a seamless metal tube with a Mannesmann process includes a body having a hole (6) formed in an axial direction of the body. The hole (6) includes an aperture (6*a*) opening at least at one end face of the round billet (5), and a tapered portion (61) continued to the aperture (6*a*) and having a diameter gradually increasing toward the aperture (6*a*).

3 Claims, 5 Drawing Sheets

(51) Int. Cl.
*B21B 3/02* (2006.01)
*B21B 25/00* (2006.01)
*B21B 45/00* (2006.01)

(52) U.S. Cl.
CPC ..... *B21B 45/004* (2013.01); *B21B 2261/08* (2013.01); *B21B 2261/10* (2013.01); *B21B 2261/12* (2013.01); *B21B 2261/20* (2013.01); *Y10T 428/12292* (2015.01)

(58) Field of Classification Search
CPC ..... B21B 19/02; B21B 19/04; B21B 19/06; B21B 19/08; B21B 2205/02; B21B 2205/04; B21B 2261/08; B21B 2261/10; B21B 2261/12; B21B 2261/20; B21J 5/10; B21C 23/085; B21C 37/065
See application file for complete search history.

(56) References Cited

U.S. PATENT DOCUMENTS

| | | | |
|---|---|---|---|
| 8,327,676 | B2 | 12/2012 | Nishimori |
| 2008/0216544 | A1 | 9/2008 | Okui et al. |

FOREIGN PATENT DOCUMENTS

| | | |
|---|---|---|
| EP | 2140950 | 1/2010 |
| EP | 2295159 | 3/2011 |
| JP | 45-9055 | 4/1970 |
| JP | 70009055 | 4/1970 |
| JP | 01-181905 | 7/1989 |
| JP | 02-34241 | 2/1990 |
| JP | 04-81209 | 3/1992 |
| JP | 05-277516 | 10/1993 |
| JP | 2002-239612 | 8/2002 |
| JP | 2010-125493 | 6/2010 |
| JP | 2010-125494 | 6/2010 |
| JP | 2011-121095 | 6/2011 |

OTHER PUBLICATIONS

"Modern Manufacturing of Steel Pipers", Changmu LI, Line 24-27 on p. 135, Metallurgical Industry Press, Sep. 30, 1982, with English translation of Chinese Office Action as a 'concise explanation' of the non patent literature.

* cited by examiner

METHOD FOR PRODUCING SEAMLESS METAL TUBE

This application is a Divisional of U.S. Ser. No. 14/394,578 filed on Oct. 15, 2014, which is a national phase of PCT/JP2013/058352 filed on Mar. 22, 2013.

TECHNICAL FIELD

The present invention relates to a round billet to be machined into a seamless metal tube with the Mannesmann process, and a method for producing a seamless metal tube.

BACKGROUND ART

As a method of producing a seamless metal tube, the press-type Ugine process and the skew rolling-type Mannesmann process are well known.

In the Ugine process, hollow round billets are prepared, each of which has a through hole formed along its axial centerline by machining or piercing-press. The hollow round billets are then hot-extruded by use of an extruder into seamless metal tubes.

In the Mannesmann process, round billets are piercing-rolled into hollow shells by use of a piercing machine. The produced hollow shells are drawing-rolled and sized into seamless metal tubes.

Compared to the Mannesmann process, the Ugine process can provide greater deformation for the round billets. Conventional high-alloy seamless metal tubes are produced with the Ugine process. The reason for this is because high alloy has a great deformation resistance, and it is difficult to produce high-alloy seamless metal tubes with the Mannesmann process.

To the contrary, the Ugine process has limitations on the equipment system if long-length seamless metal tubes are produced. In other words, the equipment system is required to be large enough for producing long-length seamless metal tubes with the Ugine process. Hence, various studies have been made on production of high-alloy seamless metal tubes with the Mannesmann process. For example, it has been suggested that round billets of starting materials are formed in a hollow shape in advance for the sake of reducing machining load in the piercing rolling.

JP2002-239612A describes a method of producing a seamless tube that, in a seamless tube production line having a heating furnace and a cross roll piercing mill, machines a starting material into a hollow shell shape before being charged in the heating furnace, heats the starting material having the hollow-shell shape in the heating furnace such that the temperature of the starting material is maintained less than a zero ductility temperature of the starting material, and thereafter, carries out drawing-rolling on this stating material with the cross roll piercing mill. The zero ductility temperature is defined in JP2002-239612A as a temperature at which ductility sharply drops in a high temperature range.

JP5-277516A describes a method of producing a high-Ni alloy seamless tube that uses a hollow shell to whose internal surface water glass is applied, and carries out the Mannesmann-rolling on the hollow shell so as to form this hollow shell into a tube.

DISCLOSURE OF THE INVENTION

Unfortunately, piercing-rolling of a hollow round billet may cause significant damages to a piercing plug, which drastically reduces durability life of the piercing plug. In some cases, the piercing plug becomes too damaged to successfully get through the piercing-rolling. The piercing plug may become damaged during the piercing-rolling, so that flaws are generated on the internal surface of the hollow shell.

An object of the present invention is to provide a round billet and a method of producing a seamless metal tube capable of reducing damages to a piercing plug during the production of the seamless metal tube with the Mannesmann process.

The round billet according to the present invention is a round billet, for use in a seamless metal tube, to be produced into a seamless metal tube with the Mannesmann process, and the round billet includes a body having a hole formed in an axial direction of the body. The hole includes an aperture opening at least at one end face of the round billet, and a tapered portion continued to the aperture and having a diameter gradually increasing toward the aperture.

A method of producing a seamless metal tube according to the present invention includes a step of preparing the above described round billet, and a step of piercing-rolling the round billet with the tapered portion of the round billet opposite to the piercing plug.

The round billet and the method of producing a seamless metal tube according to the present invention can reduce damages to the piercing plug during the production of the seamless metal tube with the Mannesmann process.

MODE FOR CARRYING OUT THE INVENTION

Figure 1:
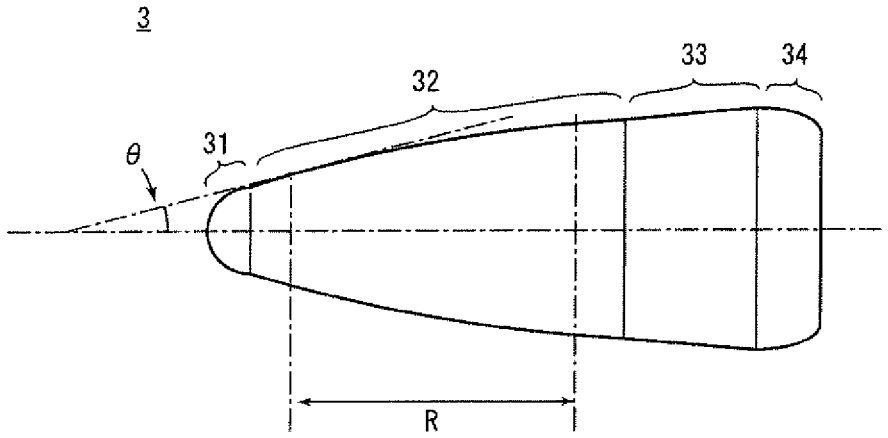
FIG. 1 is a plan view showing an outline of a configuration of a piercing plug.

Hereinafter, with reference to the drawings, detailed description will be provided on the embodiment of the present invention. In the drawings, the same or equivalent members are designated by the same reference numerals and their description will be omitted. Regarding the dimensions of the members in the drawings, the dimensions of the actual constituent members, the ratios of the dimensions of the members, and the like are not shown faithfully.

[Damages To Piercing Plug]

The present inventor has revealed that the following problems are caused if a hollow round billet is piercing-rolled. Specifically, the piercing-rolling of the hollow round billet causes significant damages to a piercing plug, which drastically reduces the durability life of the piercing plug. In some cases, the piercing-rolling cannot successfully be completed due to damages of the piercing plug. The damages caused to the piercing plug during the piercing-rolling may generate flaws on an internal surface of a hollow shell to be produced.

FIG. 1 is a plan view showing an example of an outline of a configuration of a piercing plug 3. The piercing plug 3 includes a front end portion 31, a rolling portion 32, a reeling portion 33, and a relief portion 34. The surface of the front end portion 31 has a different curvature from that of the surface of the rolling portion 32.

The piercing plug 3 has on its surface protective coating such as an oxide scale film and arc-spraying coating containing iron and iron oxide. This protective coating enhances thermal insulation performance on the surface of the piercing plug 3. Accordingly, the surface of the base metal of the piercing plug 3 can be prevented from having a high temperature. Lubricity at a high temperature can also be enhanced by the protective coating.

The front end portion 31 has a smaller heat capacity than that of the other portions, so that the front end portion 31 easily becomes high temperature. The front end portion 31 is likely to be subjected to greater rolling reduction compared to the other portions. Hence, the front end portion 31 is most likely to be damaged (melted) in the piercing rolling using a solid-core round billet.

However, according to the studies by the present inventor, in the piercing rolling using the hollow round billet, the piercing plug 3 melted in a region R shown in FIG. 1 more greatly than at the front end portion 31.

In order to investigate a cause of the melting loss on the piercing plug 3, the present inventor conducted a simulating analysis of the surface scale temperature of the piercing plug 3 and on the base metal surface temperature of the piercing plug 3. Major parameters used in this simulation are as follows. Each round billet was made of high-alloy containing 25 mass % of Cr, 50 mass % of Ni, and 6 mass % of Mo. The round billet had an outer diameter of 200 mm and an inner diameter of 65 mm. The piercing time was fixed at 20 seconds, and the heating temperature was fixed at 1200° C.

Figure 2:
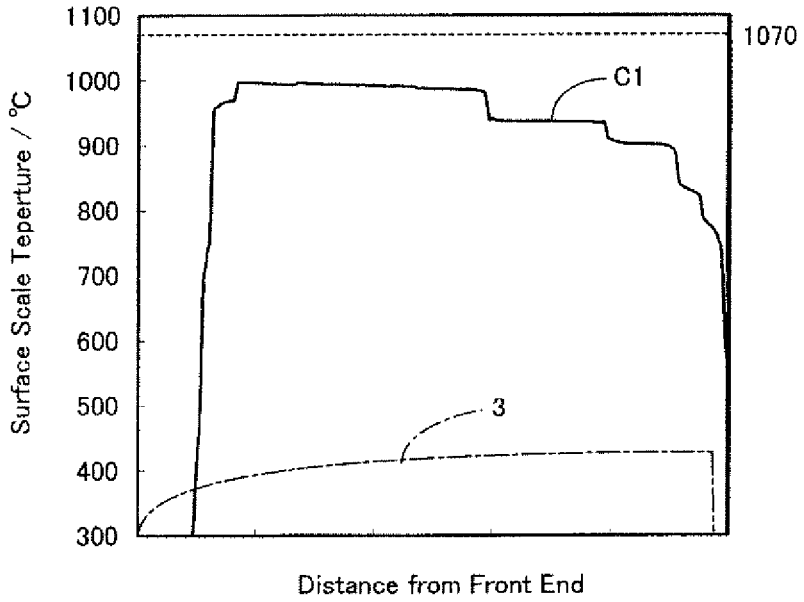
FIG. 2 is a graph showing a relation between a distance from a front end of the piercing plug and a surface scale temperature of the piercing plug.
Figure 3:
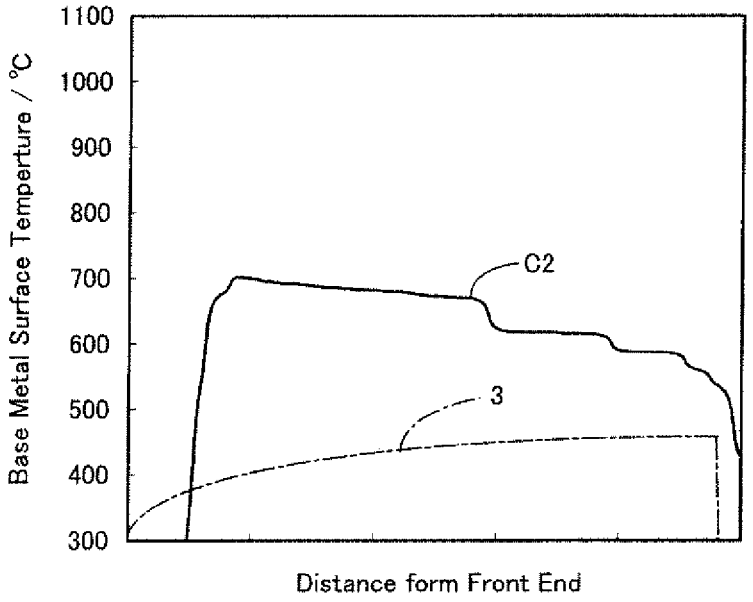
FIG. 3 is a graph showing a relation between the distance from the front end of the piercing plug and a surface base metal temperature of the piercing plug.

The result of the analysis is shown in FIG. 2 and FIG. 3. FIG. 2 is a graph showing a relation between a distance from the front end of the piercing plug 3 and a surface scale temperature C1 of the piercing plug 3. FIG. 3 is a graph showing a relation between the distance from the front end of the piercing plug 3 and a base metal surface temperature C2 of the piercing plug 3. The external shape of the piercing plug 3 is indicated by a dashed line in FIG. 2 and FIG. 3, respectively.

With reference to FIG. 2, it was found that the surface scale temperature C1 of the piercing plug 3 was less than the melting point of 1070° C. of the oxide scale even at a portion of the piercing plug 3 having the maximum temperature. The present inventor inferred from this finding that the melting loss of the piercing plug 3 relies on a mechanical factor. Specifically, the oxide scale layer on the surface of the piercing plug 3 comes off due to a mechanical impact generated by a contact between the round billet and the piercing plug 3. The base metal surface of the piercing plug 3 comes in direct contact with the round billet at the portion where the oxide scale layer is peeled off. Since the oxide scale layer having a high insulation performance is peeled off, the temperature of the base metal surface of the piercing plug 3 becomes high. Consequently, the piercing plug 3 melts.

With reference to FIG. 3, it was found that the base metal surface temperature C2 of the piercing plug 3 becomes relatively high at the rolling portion 32. Hence, it can be considered that particularly the rolling portion 32 is likely to melt if the oxide scale layer is peeled off.

Accordingly, the melting loss of the piercing plug 3 can be prevented by reducing the mechanical impact caused by the contact between the round billet and the piercing plug 3, so as to prevent the protective coating on the surface of the piercing plug 3 from coming off.

The present inventor has found that the mechanical impact caused by the contact between the round billet and the piercing plug 3 can be reduced by a taper formed on an internal surface of a hole of the hollow round billet. More specifically, it was found that this taper formed on the internal surface of the hole increases a contact area between the round billet and the piercing plug 3, which enables stress applied onto the piercing plug 3 to be distributed.

Based on the above findings, the present inventor has completed the present invention. The embodiment of the present invention will be described in detail, hereinafter.

First Embodiment

Figure 4:
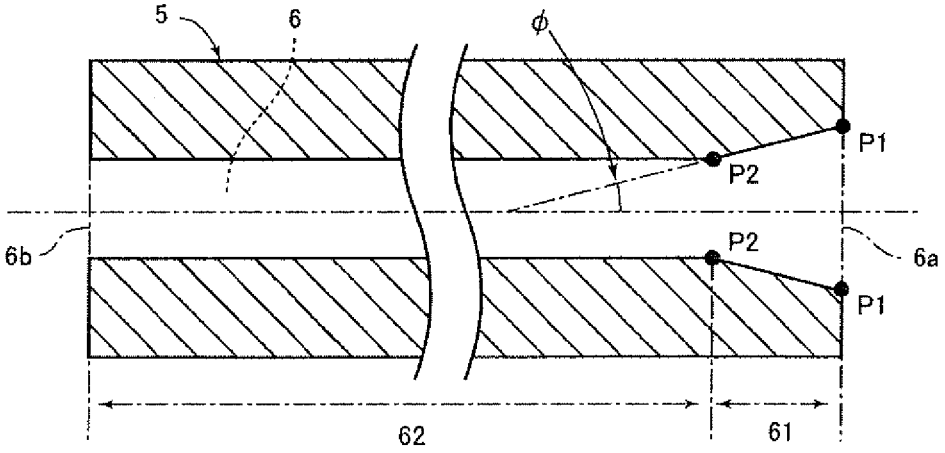
FIG. 4 is a cross section view showing an outline of a configuration of a round billet according to the first embodiment of the present invention.

FIG. 4 is a longitudinal section view showing an outline of a configuration of the round billet 5 according to the first embodiment of the present invention. A hole 6 is formed in the body of the round billet 5 in its axial direction. The hole 6 extends through the central axis of the round billet 5 in its axial direction. The hole 6 includes apertures 6*a*, 6*b* formed at both ends of the round billet 5. In other words, the hole 6 extends through the round billet 5.

The hole 6 includes a tapered portion 61, and a straight portion 62 whose diameter is substantially constant. The tapered portion 61 is continued to the aperture 6*a*, and has a diameter gradually increasing toward the aperture 6*a*. In the present embodiment, the tapered portion 61 is formed in a so-called linear taper that has a constant ratio between the distance from the aperture 6*a* and variation in diameter of the hole 6. The tapered portion 61 has a taper angle $\phi$. In the longitudinal section view of the round billet 5 (section view in FIG. 4), the taper angle $\phi$ is defined by a tangential line of the tapered portion 61 and the axial direction of the round billet 5.

[Method of Producing Round Billet 5, and Method of Producing Seamless Metal Tube]

The method of producing the round billet 5 and the method of producing the seamless metal tube according to the present embodiment will be described with reference to FIG. 5 to FIG. 7.

Figure 5:
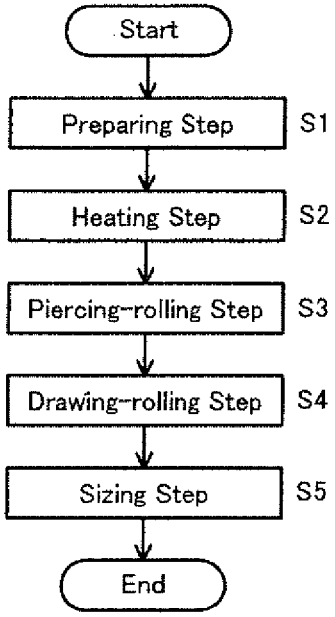
FIG. 5 is a flow chart showing an example of a method of producing a seamless metal tube using a hollow round billet with the Mannesmann process.

FIG. 5 is a flow chart showing an example of the producing steps of the seamless metal tube according to the present embodiment. First, the round billet 5 is prepared (preparing step, step S1).

The round billet 5 is obtained by machining a hollow round billet so as to form the tapered portion 61 in the hollow round billet. The hollow round billet may be obtained by machining a solid-core round billet, or may be produced in other methods. In the case of machining the solid-core round billet into the hollow round billet, boring and the formation of the tapered portion 61 may be carried out at the same time. The tapered portion 61 may be formed by lathing, for example.

The starting material of the round billet 5 is not limited to a specific one. However, the method of producing the seamless metal tube according to the present embodiment is particularly useful in the round billet 5 whose starting material is made of high alloy. The high alloy may be high Cr-high Ni alloy containing 20 to 30 mass % of Cr, 30 to 60 mass % of Ni, and 2 to 10 mass % of Mo, for example.

Subsequently, the round billet 5 is so charged in a heating furnace as to be heated (heating step, step S2). The heating furnace may be a rotary hearth furnace or a walking beam furnace, for example. The heating temperature may be 1100 to 1300° C., for example.

The heated round billet 5 is taken out from the heating furnace, and is quickly conveyed to the piercing machine through a conveyance system such as transfer rollers or a pusher. The heated round billet 5 is then piercing-rolled by the piercing machine (piercing-rolling step, step S3). Detailed description on the piercing-rolling will be provided later.

In the present description, the piercing-rolled round billet is referred to as a hollow shell in order to be distinguished from the hollow round billet 5 before the piercing-rolling.

The hollow shell is conveyed to a drawing-rolling mill through the conveyance system. Subsequent to this, the hollow shell is drawing-rolled by the drawing-rolling mill (drawing-rolling step, step S4). The drawing-rolling mill may be a plug mill or a mandrel mill, for example.

The drawing-rolled hollow shell is conveyed to a sizer through the conveyance system. The drawing-rolled hollow shell is sized by the sizer (sizing step, step S5). The sizer may be a sizing mill or a stretch reducer, for example. Through the above steps, the seamless metal tube is produced.

Hereinafter, detailed description will be provided on the piercing-rolling step (step S3). FIG. 6 is a plan view showing an outline of a configuration of a piercing machine P for use in the piercing-rolling step. FIG. 7 is a side view of the piercing machine P. The piercing machine P includes a pair of skew rolls 1A, 1B, a mandrel 2, a piercing plug 3 mounted to a front end of the mandrel 2, and a pair of disk rolls 4A, 4B. FIG. 6 and FIG. 7 show schematic cross sectional views of the round billet 5 together with the hollow shell HS. The disk rolls 4A and 4B are omitted in FIG. 6. In FIG. 7, the skew roll 1A is omitted, and the skew roll 1B is represented by a dashed line.

The skew rolls 1A and 1B are disposed to be opposite to each other with a pass line PL along which the round billet 5 moves located therebetween. In FIG. 6 and FIG. 7, the skew rolls 1A and 1B are disposed in a horizontal plane, but the skew rolls 1A and 1B may be disposed in the vertical direction with the pass line PL located therebetween, instead. Hereinafter, a direction parallel to the pass line PL is defined as an x direction, a direction vertical to the x direction in the horizontal plane is defined as a y direction, and a direction vertical to both the x direction and the y direction is defined as a z direction.

Each of the skew rolls 1A and 1B includes a shaft portion 11 and a roll portion 12 that are coaxial with each other. The shaft portion 11 is supported at its both ends by bearings (not shown). The skew rolls 1A and 1B rotate around their shaft portions 11 as their rotational axes in the same rotational direction with a motor (not shown).

Figure 6:
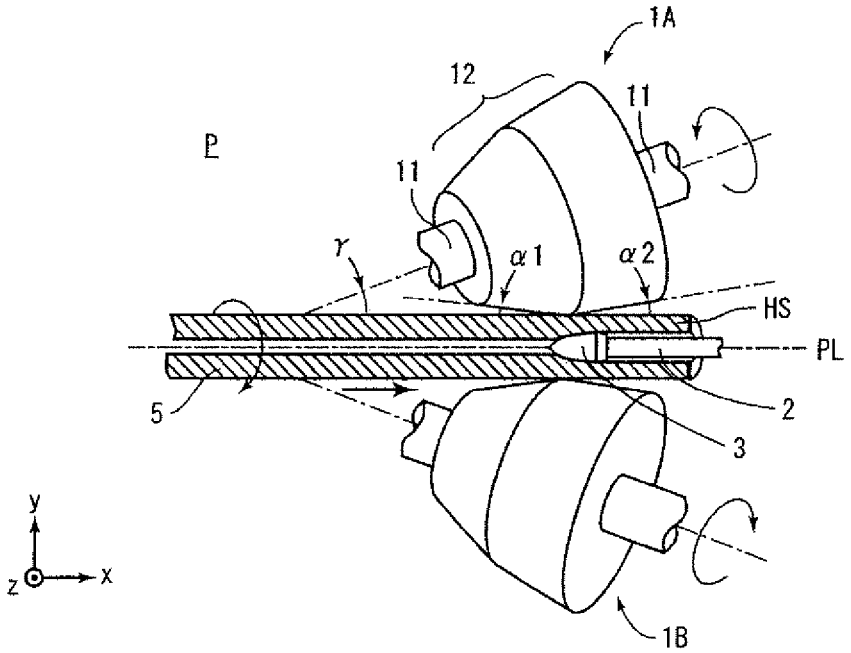
FIG. 6 is a plan view showing an outline of a configuration of a piercing machine for use in a piercing-rolling step.
Figure 7:
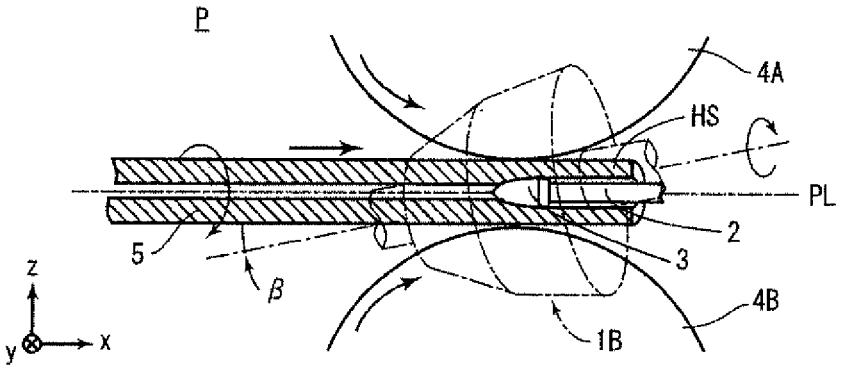
FIG. 7 is a side view of the piercing machine.

As shown in FIG. 6, the skew rolls 1A and 1B are so disposed as to tilt relative to the x-z plane by a toe angle $\gamma$ in the opposite direction to each other. As shown in FIG. 7, the skew rolls 1A and 1B are also tilted in the opposite direction to each other relative to the x-y plane by a feed angle $\beta$.

A distance between the surface of the roll portion 12 of the skew roll 1A and the surface of the roll portion 12 of the skew roll 1B (roll opening) is smaller than the outer diameter of the round billet 5 at the entrance side. Each roll portion 12 defines an entrance-side face angle $\alpha$1 and a delivery-side face angle $\alpha$2 relative to the x-z plane.

The disk rolls 4A and 4B are so disposed as to be opposite to each other with the pass line PL located therebetween in the x-z plane. Each of the disk rolls 4A and 4B includes an arc-shaped guide face, so as to guide the round billet 5.

The position of the round billet 5 is adjusted by an approach table device (not shown). For example, the pass line PL is so adjusted as to be substantially coaxial with the mandrel 2 and the piercing plug 3 by using a trough having an elevating mechanism such as an electric wedge. The round billet 5 is pushed toward the skew rolls 1A and 1B by a pusher (not shown).

When the front end of the round billet 5 is caught between the skew rolls 1A and 1B, the round billet BL is rotated by the skew rolls 1A and 1B, and is moved in the x direction by the effect of the feed angle $\beta$. In this manner, the round billet 5 is so pushed against the piercing plug 3 as to be pierced. Specifically, the inner diameter of the hollow round billet 5 is enlarged, and formed into the hollow shell HS.

As an index representing a reduction rate by the piercing-rolling, a piercing ratio is used. The piercing ratio is defined by dividing the length of the hollow shell HS in the axial direction by the length of the round billet 5 in the axial direction. The total reduction in area can be reduced by using the hollow round billet 5, compared to the case of using a solid-core round billet even if both have the same piercing ratio.

Effects of the First Embodiment

Figure 8:
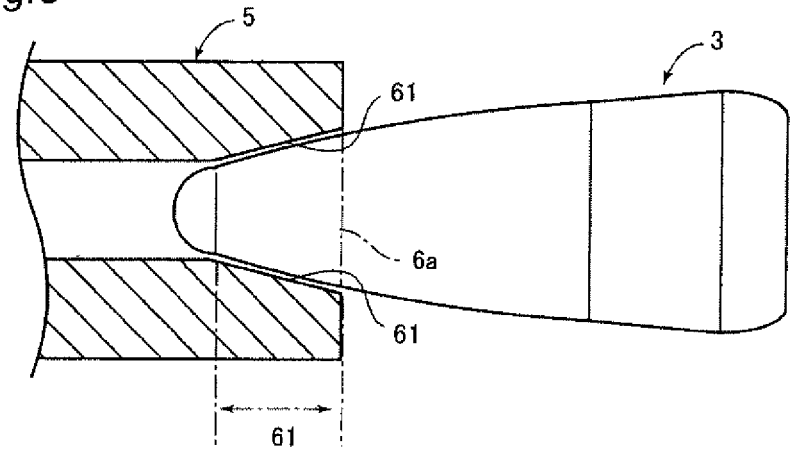
FIG. 8 is a schematic view showing a state of the round billet in contact with the piercing plug in the piercing-rolling of the round billet according to the first embodiment of the present invention.
Figure 9:
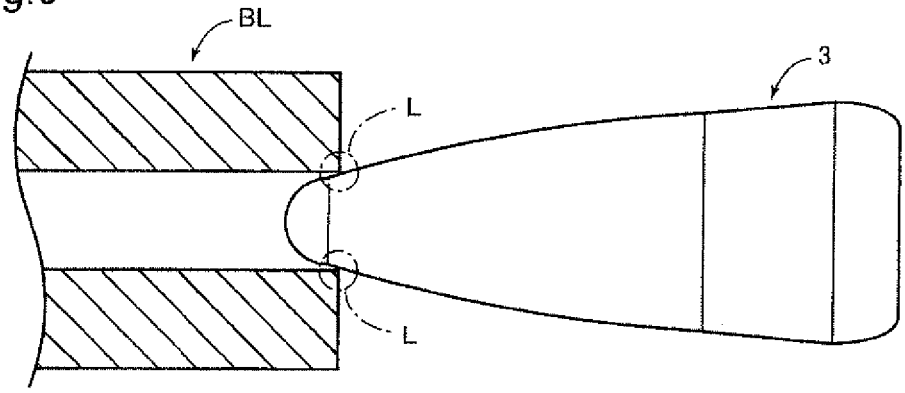
FIG. 9 is a schematic view showing a state of the round billet in contact with the piercing plug in the piercing-rolling of a hollow round billet having no tapered portion.

The effects of the present embodiment will be described with reference to FIG. 8 and FIG. 9. FIG. 8 is a schematic view showing a state of the round billet 5 in contact with the piercing plug 3 in the piercing-rolling of the round billet 5. FIG. 9 is a schematic view showing a state of the round billet BL having no tapered portion in contact with the piercing plug 3 in the piercing-rolling of the hollow round billet BL. In FIG. 8 and FIG. 9, the round billet 5 and the round billet BL are shown in their cross sectional views.

As shown in FIG. 8, in the present embodiment, the round billet 5 comes in contact with the piercing plug 3 at its end face having the aperture 6*a*. The piercing plug 3 comes in surface contact with the tapered portion 61 on the internal surface of the hole 6. To the contrary, as shown in FIG. 9, the piercing plug 3 comes in contact with an edge L of the aperture of the hole in the piercing-rolling of the round billet BL. As obvious from the comparison between FIG. 8 and FIG. 9, the round billet 5 of the present embodiment secures a greater contact area between the internal surface of the hole 6 and the piercing plug 3. The greater contact area enables the stress applied onto the piercing plug 3 to be distributed. In other words, the stress can be prevented from being concentrated on a local portion of the piercing plug. Accordingly, it is possible to prevent the protective coating such as the oxide scale film and the arc-spraying coating formed on the surface of the piercing plug 3 from being peeled off, thereby preventing the melting loss of the piercing plug 3.

The taper angle ϕ of the round billet 5 is preferably at least a rolling portion angle θ of the piercing plug 3 that is defined as follows.

With reference to FIG. 1, the radius of curvature at the rolling portion 32 of the piercing plug 3 is greater by substantially one order to two orders of magnitude than that at the front end portion 31 of the piercing plug 3. Hence, the longitudinal section shape of the rolling portion 32 can be approximated by a straight line that defines the angle θ relative to the center line of the piercing plug 3. Hereinafter, this angle θ is referred to as the rolling portion angle θ of the piercing plug 3. In the present description, the rolling portion angle θ is defined as a maximum value of an angle defined by a tangential line circumscribed to the rolling portion 32 and the center line of the piercing plug 3. The rolling portion angle θ is generally 5 to 20 degrees.

If the taper angle ϕ is equal to the rolling portion angle θ, the contact area between the round billet 5 and the piercing plug 3 becomes the greatest.

As described above, the roll opening of the piercing machine P is usually smaller than the outer diameter of the round billet 5 at the entrance side. Consequently, the front end portion of the round billet 5 is compressed, so that the diameter of the aperture 6*a* is reduced. Accordingly, the taper angle ϕ becomes smaller when the round billet 5 comes in contact with the piercing plug 3. Taking this reduction into consideration, the taper angle ϕ is preferably equal to the rolling portion angle θ or more.

As described above, the rolling portion angle θ of the piercing plug 3 is generally 5 to 20 degrees, and thus the taper angle ϕ is preferably 5 to 45 degrees, and more preferably 6 to 25 degrees.

The length L of the tapered portion 61 is preferably less than the length of the rolling portion 32 of the piercing plug 3. A longer portion in the tapered portion 61 than the length of the rolling portion 32 of the piercing plug 3 does not contribute to increase of the contact area between the round billet 5 and the piercing plug 3. The machining load for forming the tapered portion 61 can be reduced by reducing the length L of the tapered portion 61 to be less than the length of the rolling portion 32 of the piercing plug 3.

The upper limit of the length of the tapered portion 61 is preferably at most 250 mm, and more preferably at most 100 mm. The lower limit of the length of the tapered portion 61 is preferably at least 5 mm, more preferably at least 10 mm, and further more preferably more than 10 mm.

A region P1 adjacent to the aperture 6*a* of the tapered portion 61 is preferably chamfered. The reason for this is because a line contact between the round billet 5 and the piercing plug 3 can be prevented in the region P1. It is more preferable that a region P2 adjacent to the straight portion 62 of the tapered portion 61 is also chamfered. The reason for this is because the line contact between the round billet 5 and the piercing plug 3 can be prevented in the region P2. The above "chamfering" includes a so-called round chamfering.

In the present embodiment, the tapered portion 61 has been described by using an example of a linear taper. The tapered portion 61 is not limited to the linear taper. If the tapered portion 61 has a greater curvature, the contact area with the piercing plug 3 becomes smaller. Hence, the tapered portion 61 is preferably a linear taper or a non-linear taper having a small curvature.

Variation of First Embodiment

Figure 10:
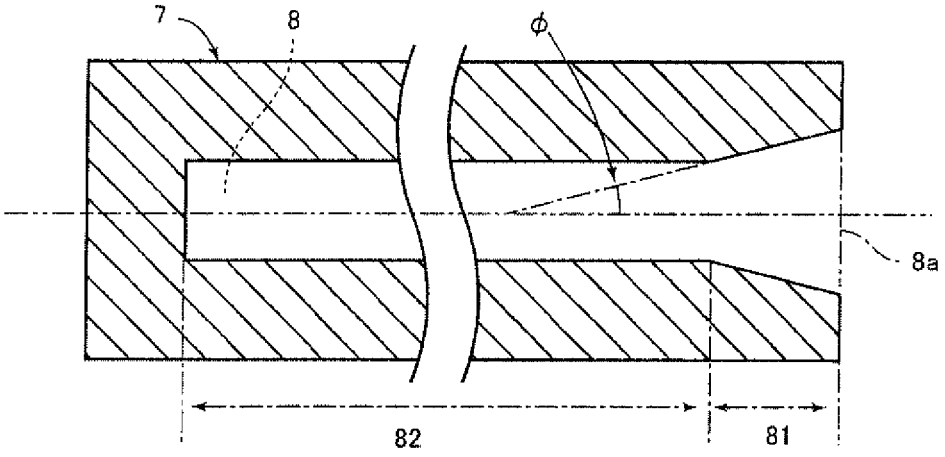
FIG. 10 is a cross section view showing an outline of a configuration of a round billet according to a variation of the first embodiment of the present invention.

FIG. 10 is a cross sectional view showing an outline of a configuration of a round billet 7 according to a variation of the first embodiment of the present invention. The round billet 7 includes body having a hole 8 formed along the axial direction of the body. The hole 8 extends through the central axis of the round billet 7 in the axial direction of the round billet 7. The hole 8 includes an aperture 8*a* opening at one end face of the round billet 7. In other words, the hole 8 does not extend through the round billet 7.

As similar to the hole 6 of the round billet 5, the hole 8 of the round billet 7 includes a tapered portion 81 that is continued to the aperture 8*a*, and has a diameter gradually increasing toward the aperture 8*a*, and a straight portion 82 whose diameter is substantially constant. The tapered portion 81 has a taper angle ϕ.

The present variation can achieve substantially the same effects as those by the first embodiment. Specifically, the total reduction in area can be reduced in the piercing-rolling of the round billet 7, compared to the case of using a solid-core round billet even if the hole 8 does not extend through the round billet 7.

The tapered portion 81 formed on the internal surface of the hole 8 increases the contact area between the round billet 7 and the piercing plug 3 when they come in contact with each other. Accordingly, it is possible to prevent deterioration of the insulation performance due to peel-off of the oxide scale layer as well as the melting loss of the piercing plug 3 due to deterioration of the insulation performance.

As shown in the present variation, the hole formed in the round billet may have an aperture that opens at least at one end portion of the round billet, and may include a tapered portion that is continued to the aperture and has a diameter gradually increasing toward this aperture.

Other Embodiments

The embodiment of the present invention has been described as above, but the present invention is not limited to the aforementioned embodiment, and various modifications may be made within the scope of the present invention.

Example

Hereinafter, the present invention will be described in more detail based on the following Example. The present invention is, however, not limited to this Example.

Plural round billets having holes in various shapes were piercing-rolled, and comparison was conducted on the degree of damage on each piercing plug after the piercing-rolling.

Figure 11:
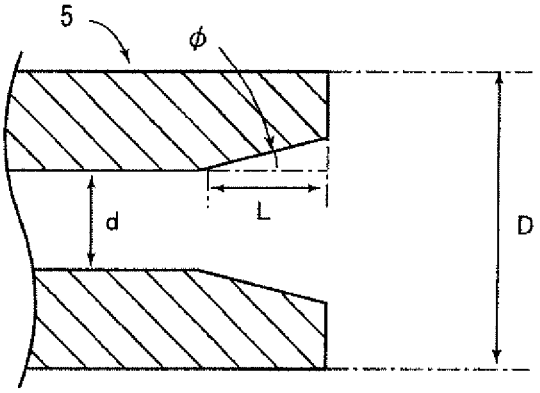
FIG. 11 is a drawing explaining a size of a round billet according to the Example.

The staring materials of each round billet used in the piercing-rolling was made of a high Cr-high Ni alloy containing 0.002 to 0.02 mass % of C, 0.01 to 0.5 mass % of Si, 0.1 to 1 mass % of Mn, 23 to 26 mass % of Cr, 47 to 54 mass % of Ni, and 6 to 9 mass % of Mo. The size of each round billet is shown in Table 1. The meanings of the reference symbols in Table 1 are as shown in FIG. 11. Specifically, the reference symbol D designates the outer diameter (mm) of the round billet, the reference symbol d designates the inner diameter (mm) of the round billet, the reference symbol L designates the length of the tapered portion (mm), and the reference symbol ϕ designates the taper angle (°), respectively.

TABLE 1

| | D (mm) | d (mm) | L (mm) | φ (°) |
|---|---|---|---|---|
| Inventive Example 1 of Present Invention | 200 | 65 | 100 | 13 |
| Inventive Example 2 of Present Invention | 200 | 65 | 15 | 18 |
| Inventive Example 3 of Present Invention | 200 | 65 | 10 | 45 |
| Comparative Example | 200 | 65 | No Taper | |

As shown in Table 1, each round billet of the Inventive Examples 1 to 3 of the present invention had an equal outer diameter D and an equal inner diameter d. Although each taper portion was a linear taper, the size of each taper portion was different from one another. Each round billet of the Comparative Example had a through hole having the same inner diameter, and had no tapered portion. The piercing-rolling was conducted on each round billet under the same conditions other than the above conditions. The rolling portion angle θ of the piercing plug was 12 degrees. Visual observation was conducted on the surface of each piercing plug after the piercing-rolling, so as to confirm whether or not there occurred any melting loss on the piercing plug.

In the piercing-rolling using the round billets of the Inventive Example 1 of the present invention, there was no melting loss on the piercing plug even after producing two hollow shells having a length of 8 m. There was no flaw on the internal surface of each hollow shell that was pierced rolled.

In the piercing-rolling using the round billets of the Inventive Example 2 of the present invention, there was no melting loss on the piercing plug even after producing two hollow shells having a length of 8 m. There was no flaw on the internal surface of each hollow shell that was pierced rolled.

In the piercing-rolling using the round billets of the Inventive Example 3 of the present invention, there was no melting loss on the piercing plug even after producing two hollow shells having a length of 8 m. There were, however, flaws on the internal surface of each hollow shell that was pierced rolled.

Comparative Example

In the piercing-rolling using the round billets of the Comparative Example, no hollow shell having a length of 8 m was produced because of the melting loss on the piercing plug during the piercing-rolling. Another piercing-rolling was conducted using a round billet having a different length, and the piercing plug was melted at the moment when the hollow shell having a length of 5 m was produced.

INDUSTRIAL APPLICABILITY

The present invention is widely applicable to round billets to be machined into seamless metal tubes, and particularly the present invention is industrially applicable as a method of producing seamless metal tubes with the Mannesmann process.

The invention claimed is:

1. A method for producing a seamless metal tube comprising:

a step of preparing a piercing plug for use in a Mannesmann process, the piercing plug having a protective coating and having a rolling portion angle of 5 to 20 degrees;

a step of preparing a round billet, to be produced into a seamless metal tube with the Mannesmann process, the round billet having an outer diameter, the outer diameter being substantially constant along an entire axial length of the round billet, and further comprising: a body having a hole formed along an axial direction of the body, wherein the hole extends completely through the round billet and includes: an aperture opening at least at one end face of the round billet; a tapered portion continued to the aperture and having a tapered portion diameter gradually increasing toward the aperture; and a straight portion having an inner diameter, the inner diameter being substantially constant, the straight portion adjacent to the tapered portion; and a step of piercing-rolling the round billet after positioning the tapered portion of the round billet opposite to the piercing plug, wherein the tapered portion has a length in the axial direction of 10 to 100 mm, and a taper angle of 6 to 25 degrees, and the taper angle is greater than the rolling portion angle of the piercing plug, and further wherein providing the tapered portion reduces removal of the protective coating and subsequent melting of the piercing plug during the piercing-rolling step.

2. The method for producing a seamless metal tube according to claim 1, wherein the length of the tapered portion is less than a length of the rolling portion of the piercing plug.

3. The method for producing a seamless metal tube according to claim 1, wherein the tapered portion has a region adjacent to the aperture, and the region is chamfered.

* * * * *